US012220043B2

(12) United States Patent
Guerrier

(10) Patent No.: US 12,220,043 B2
(45) Date of Patent: Feb. 11, 2025

(54) CUSTOMIZABLE HAIR ACCESSORY

(71) Applicant: Withmey Guerrier, Orlando, FL (US)

(72) Inventor: Withmey Guerrier, Orlando, FL (US)

( * ) Notice: Subject to any disclaimer, the term of this patent is extended or adjusted under 35 U.S.C. 154(b) by 397 days.

(21) Appl. No.: 17/444,062

(22) Filed: Jul. 30, 2021

(65) Prior Publication Data

US 2022/0053904 A1 Feb. 24, 2022

Related U.S. Application Data

(60) Provisional application No. 63/069,200, filed on Aug. 24, 2020.

(51) Int. Cl.
*A45D 8/00* (2006.01)
*A45D 8/20* (2006.01)

(52) U.S. Cl.
CPC ..... *A45D 8/006* (2021.01); *A45D 8/008* (2021.01); *A45D 8/20* (2013.01)

(58) Field of Classification Search
CPC ..... A45D 8/004; A45D 8/006; A45D 8/008; A45D 8/34
See application file for complete search history.

(56) References Cited

U.S. PATENT DOCUMENTS 717,499 A * 12/1902 Guoy ..... A45D 8/34 132/133
958,872 A 5/1910 Holzhey et al.
D180,713 S * 7/1957 Hammond ..... D28/23
3,192,932 A * 7/1965 Hart ..... A45D 8/006 132/275
D322,145 S * 12/1991 Coignard ..... D28/23
5,573,018 A * 11/1996 Johnson ..... A45D 8/006 132/273

(Continued)

FOREIGN PATENT DOCUMENTS

CN 2919976 * 6/2006
GB 2219741 A * 12/1989 ..... A45D 8/34

(Continued)

OTHER PUBLICATIONS

Machine Translation of Tang, Available Jun. 2006.*

*Primary Examiner* — Rachel R Steitz
*Assistant Examiner* — Brianne E Kalach
(74) *Attorney, Agent, or Firm* — Dunlap Bennett & Ludwig, PLLC; Anna L. Kinney

(57) ABSTRACT

A decorative hair accessory has a hinged, substantially cylindrical attachment base assembly and at least one interchangeable decorative component. The base assembly includes a curved, elongated first clasp element and a curved, elongated second clasp element forming a hinge along a first longitudinal edge on the first clasp element and a second longitudinal edge on the second clasp element. The first clasp element has a first latching element along a third longitudinal edge and the second clasp element has a second latching element along a fourth longitudinal edge. The first latching element and the second latching element mate. At least one of the first clasp element and the second clasp element have a way to attach on an exterior surface. The decorative component has a second way to attach. The first and the second way to attach couple together. The decorative component has indicia opposite the second way to attach.

8 Claims, 4 Drawing Sheets

(56) References Cited

U.S. PATENT DOCUMENTS

| | | | | | |
|---|---|---|---|---|---|
| 5,722,437 | A * | 3/1998 | Chang | A45D 8/24 | 132/275 |
| 5,810,022 | A | 9/1998 | Reynolds | | |
| 5,845,655 | A * | 12/1998 | Iwata | A45D 8/34 | 132/54 |
| 6,016,813 | A | 1/2000 | Kennedy | | |
| 6,311,699 | B1 * | 11/2001 | Horman | A45D 8/34 | 132/273 |
| 6,688,316 | B1 | 2/2004 | Klug | | |
| 8,752,561 | B1 | 6/2014 | Wendschuh | | |
| 9,138,039 | B2 | 9/2015 | DeBenedictis et al. | | |
| 9,439,489 | B1 | 9/2016 | Townsell | | |
| 10,258,133 | B2 | 4/2019 | Beck et al. | | |
| 2004/0164034 | A1 | 8/2004 | Costanza | | |
| 2005/0056298 | A1 * | 3/2005 | McRoberts | A45D 8/34 | 132/276 |
| 2005/0247327 | A1 | 11/2005 | Ison | | |
| 2007/0261708 | A1 | 11/2007 | Makino et al. | | |
| 2008/0097152 | A1 | 4/2008 | Stefanchik et al. | | |
| 2008/0149130 | A1 * | 6/2008 | Brown | A45D 8/34 | 132/279 |
| 2009/0266375 | A1 | 10/2009 | Patredis | | |
| 2012/0180805 | A1 | 7/2012 | Conway | | |
| 2013/0186424 | A1 * | 7/2013 | Zachery | A45D 8/34 | 132/275 |
| 2013/0192626 | A1 | 8/2013 | Cohen | | |
| 2017/0224079 | A1 * | 8/2017 | Egner | A45D 8/14 | |

FOREIGN PATENT DOCUMENTS

| | | | |
|---|---|---|---|
| GB | 2543765 | * | 6/2017 |
| WO | WO 2017205904 | * | 12/2017 |

* cited by examiner

CUSTOMIZABLE HAIR ACCESSORY

CROSS-REFERENCE TO RELATED APPLICATION

This application claims the benefit of priority of U.S. provisional application No. 63/069,200, filed Aug. 24, 2020, the contents of which are herein incorporated by reference.

BACKGROUND OF THE INVENTION

The present invention relates to hair accessories and, more particularly, to a customizable hair accessory.

Commercially available decorative hair devices only provide a single preconceived design, limiting the user to selecting from what is available. To achieve a different appearance, the user must remove and replace the entire device. As a result, the user must buy multiple accessories for different events, holidays, etc.

As can be seen, there is a need for a hair accessory with interchangeable appearances.

The present invention provides a customizable decorative hair accessory enabling selection and assembly or exchange of a decorative piece or ornamental embellishment to an attachment base assembly without removing the base from the user's hair. The versatile accessory provides women, children, and men with braids and locs an opportunity to express their creativity and individuality with a decorative hair accessory and multiple interchangeable designs. The inventive accessory enables the user to become a creator, expressing themselves through art and accessories.

SUMMARY OF THE INVENTION

In one aspect of the present invention, a decorative hair accessory comprising a hinged, substantially cylindrical attachment base assembly comprising a curved, elongated first clasp element and a curved, elongated second clasp element hingedly coupled along a first longitudinal edge on the first clasp element and a second longitudinal edge on the second clasp element, the first clasp element having a first latching element along a third longitudinal edge and the second clasp element having a second latching element along a fourth longitudinal edge, wherein the first latching element and the second latching element are operative to matingly engage, with a first attachment means on an exterior surface of at least one of the first clasp element and the second clasp element; and at least one interchangeable decorative component with a second attachment means on a first surface operative to couple with the first attachment means and an indicia on a second surface opposite the first surface.

These and other features, aspects and advantages of the present invention will become better understood with reference to the following drawings, description, and claims.

DETAILED DESCRIPTION OF THE INVENTION

Figure 1:
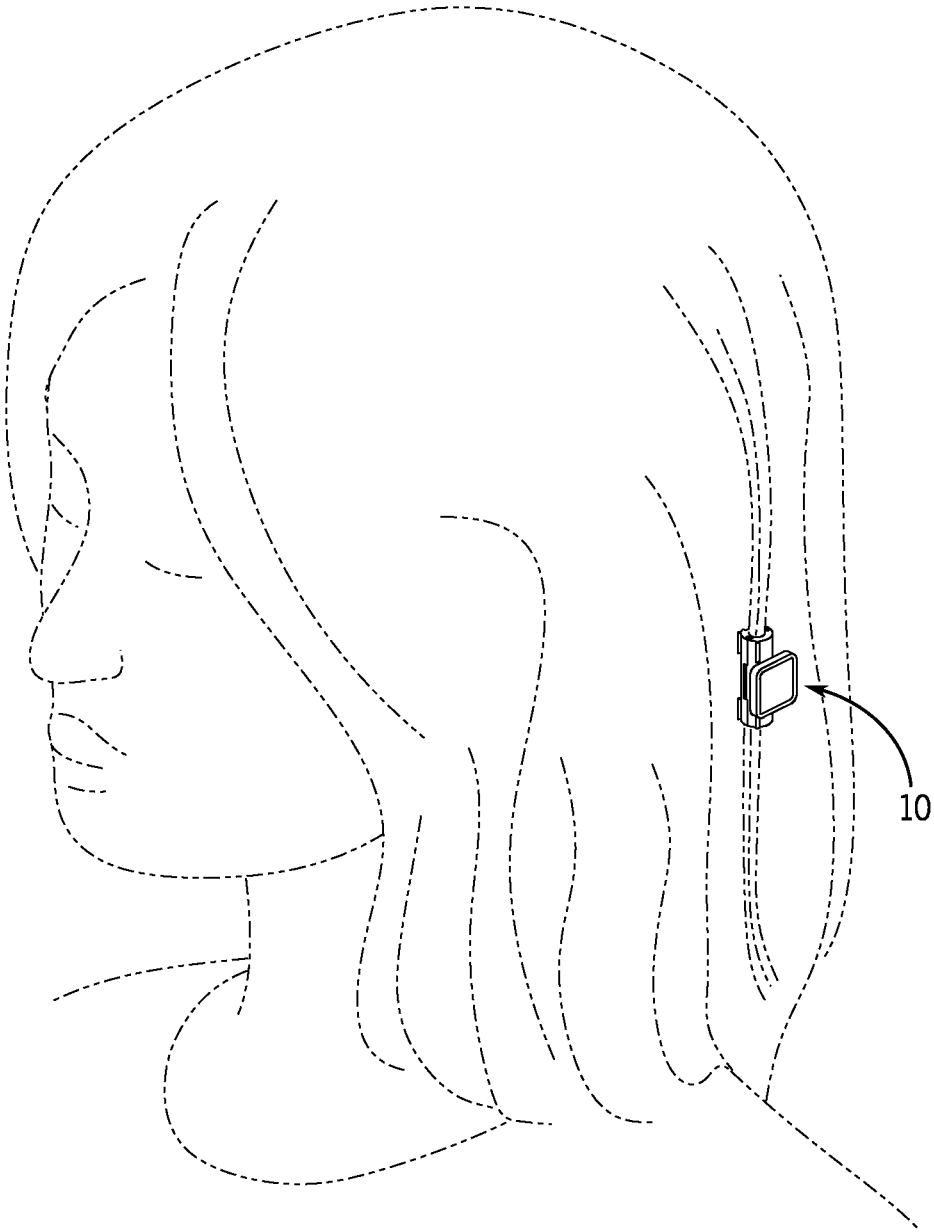
FIG. 1 is a front perspective view of a decorative hair accessory according to an embodiment of the present invention, shown in use.

The following detailed description is of the best currently contemplated modes of carrying out exemplary embodiments of the invention. The description is not to be taken in a limiting sense but is made merely for the purpose of illustrating the general principles of the invention, since the scope of the invention is best defined by the appended claims.

Broadly, one embodiment of the present invention is a decorative hair accessory comprising an attachment base assembly and one or more interchangeable decorative components.

The attachment base assembly comprises a first curved clasp element and a second curved clasp element hingedly coupled to one another to form a substantially cylindrical or tubular shape when in a closed condition. The diameter and the length of the attachment base assembly are not particularly limited. For example, the length may be about ¾" to about 3", such as about 1.5". The first clasp element and second clasp element preferably each have an elongated, substantially semi-circular structure with an interior surface and an exterior surface.

A first longitudinal edge of the first clasp element and of the second clasp element may be joined such that they rotate at a hinge. The first clasp element may have a first latching element hinge and the second clasp element may have a second latching element on a second longitudinal edge opposite the hinge, wherein the first latching element and the second latching element are operative to matingly engage and to disengage, enabling the user to open and close the attachment base assembly. In some cases, the first latching element and/or the second latching element comprise more than one protrusion extending from the second longitudinal edge of the respective latching element. Curved finger tabs may extend from both clasp elements to enable opening the device.

A first attachment means is provided on the exterior surface of at least one of the first clasp element and the second clasp element, e.g., midway longitudinally along the exterior surface thereof. The first attachment means may comprise an aperture with a keyed locking structure. The aperture is preferably substantially circular in shape. The keyed locking structure preferably includes a slot that extends radially outward from the peripheral edge of the aperture to form a slotted aperture and a keyway or an undercut groove adjacent to the aperture perimeter to removably retain a key within the keyway. The first attachment means may enable use of multiple decorative attachments on a single base.

A second attachment means is provided on the interchangeable decorative component and is operative to mate or couple with the first attachment means. In some embodiments, the second attachment means is a protuberance or cylindrical protrusion extending from a surface of the interchangeable decorative component. For example, the protuberance may be centrally located on a planar surface or a substantially planar surface. At an end of the protuberance, a tab may extend radially therefrom to form a tabbed protuberance. The tab is operative to pass through the slot of the first attachment means and to rotate into the undercut groove, thereby holding the interchangeable decorative component in place when rotated.

In some embodiments, additional keyhole structures may be present.

In some embodiments, the first attachment means and/or the second attachment means connecting the decorative component to the attachment base assembly are selected from, but not limited to, magnets, snaps, clips, hooks, and combinations thereof.

In some embodiments, the decorative component attachment means may be positioned off-center along the curve of the clasp element exterior surface, such as adjacent to the first latching element or the second latching element. Hairpin slots may be provided on the exterior surface of one or both clasp elements. The hairpin slots enable the use of hairpins with the inventive decorative hair assembly. For example, a hairpin may be inserted into the cylindrical attachment base parallel to the longitudinal axis thereof.

The decorative component may be provided in a variety of shapes and sizes. For example, the decorative component may have a square shape with rounded corners and a planar surface or substantially planar surface on which indicia are displayed. A frame may be provided around the decorative component sides and may extend from the planar surface perpendicularly. The decorative component attachment means may be adapted accordingly.

The components of the decorative hair assembly may be three-dimensionally (3D) printed or manufactured using a mold. The materials of manufacture are not particularly limited. For example, the first clasp element, the second clasp element, and the decorative component may be made of plastic.

Figure 2:
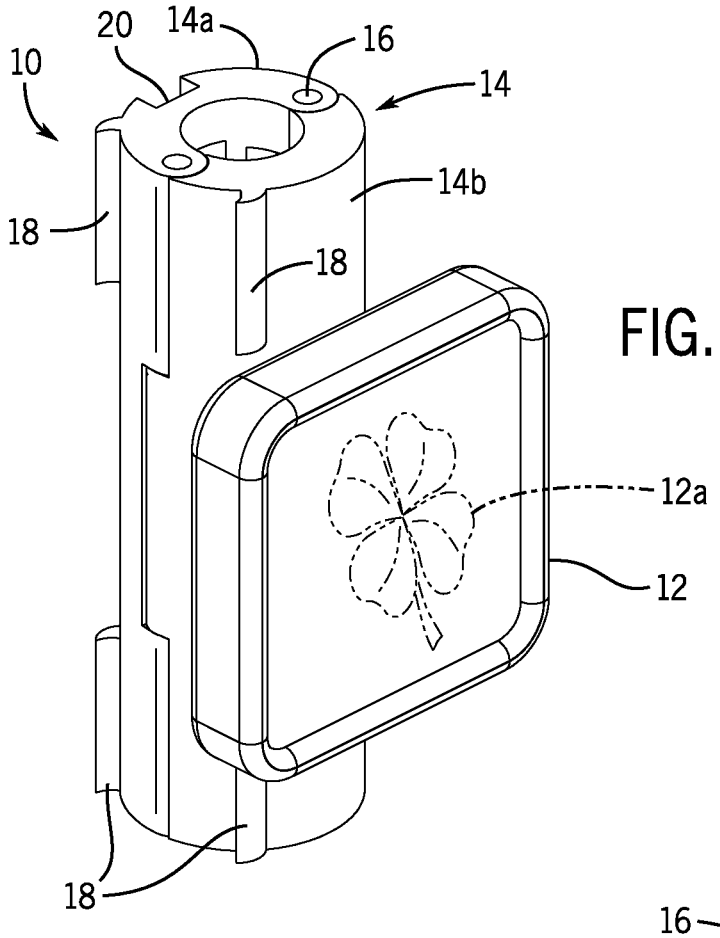
FIG. 2 is another front perspective view thereof.
Figure 3:
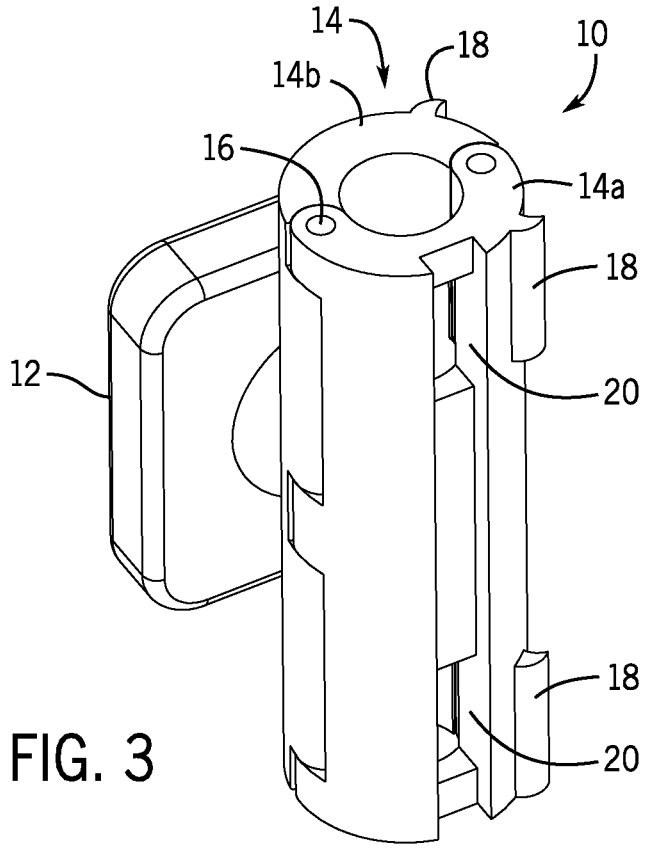
FIG. 3 is a rear perspective view thereof.
Figure 4:
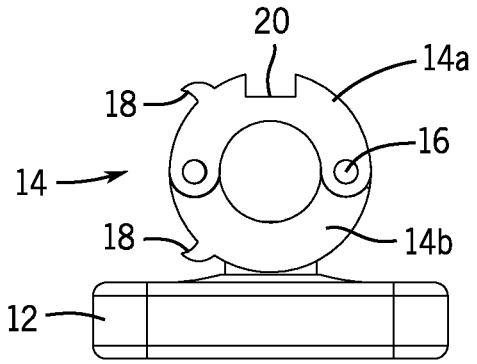
FIG. 4 is a top plan view thereof.
Figure 5:
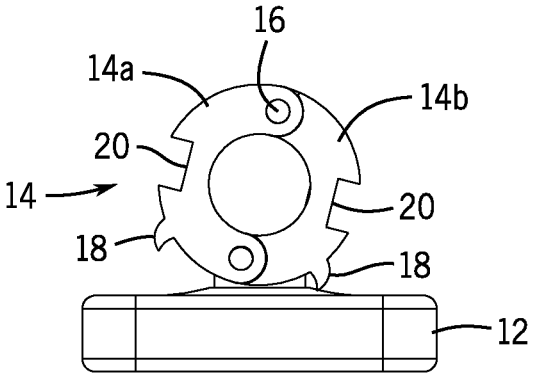
FIG. 5 is a top plan view of a decorative hair accessory according to another embodiment of the present invention.
Figure 6:
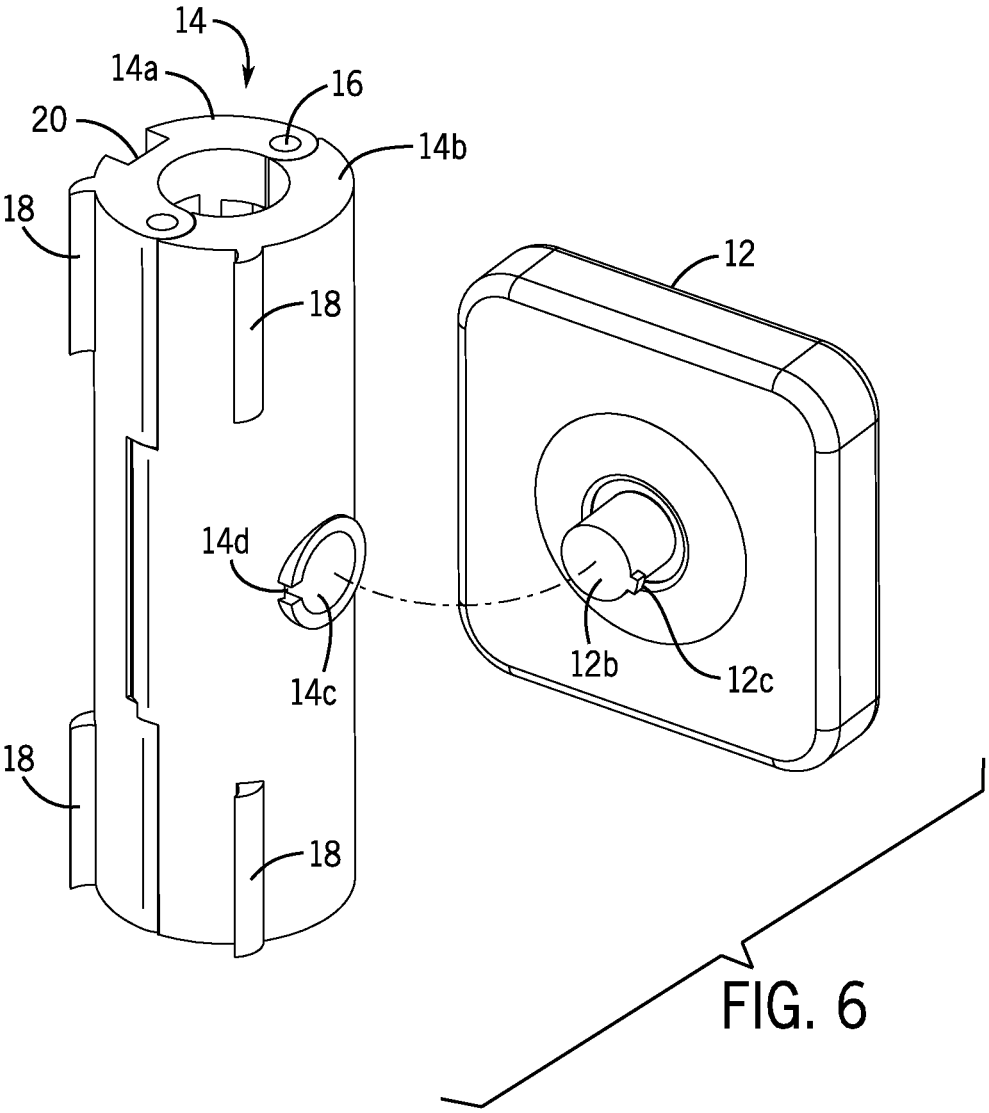
FIG. 6 is an exploded clamshell perspective view of the accessory of FIG. 4.

Referring to FIGS. 1 through 8, FIG. 1 shows a decorative hair accessory 10 according to an embodiment of the present invention clipped in a user's hair. As shown in FIG. 2, the hair accessory 10 includes a hinged tubular component 14 and a removable decorative component 12, as illustrated in FIG. 6. The hinged tubular component 14 comprises a first element 14*a* and a second element 14*b* hingedly connected with a pivot pin 16. The first element 14*a* and the second element 14*b* each have a pair of finger tabs 18 enabling the user to grasp and open the hair accessory 10. The first element has clearance or hairpin slots 20. The second element 14*b* has an aperture that receives the decorative component 12.

Alternatively, as shown in FIG. 5, the decorative component 12 may be received by an aperture approximately opposite the pivot pin 16 on the tubular component 14, with clearance slots 20 or hairpin slots present on both elements 14*a*, 14*b*. The decorative component 12 has a decorative indicia 12*a* on a first surface.

Figure 8:
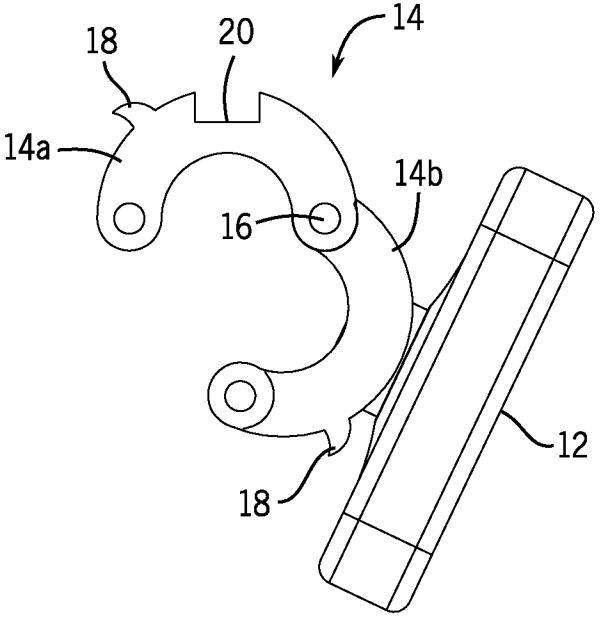
FIG. 8 is a top plan view thereof, shown in a hinged-open position.
Figure 7:
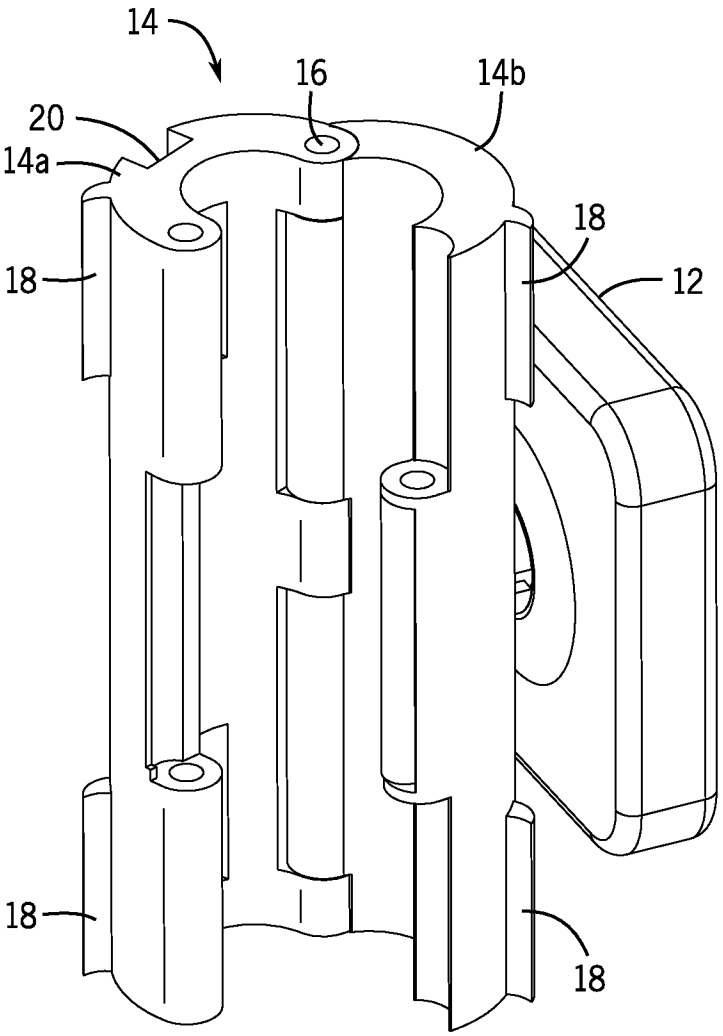
FIG. 7 is a perspective view thereof, shown in a hinged-open position.

FIG. 6 illustrates a socket 14*c* and slot 14*d* configured to receive a "key" comprising a protuberance 12*b* with a tab 12*c* on the decorative component 12 on a second surface opposite the indicia 12*a*. The protuberance and tab 12*b*, 12*c* may be inserted into the socket and slot 14*c*, 14*d* and rotated to lock the decorative component in place. The hinged tubular component 14 may be opened by rotating the first element 14*a* and the second element 14*b* apart opposite the pivot pin 16, as shown in FIGS. 7 and 8.

It should be understood, of course, that the foregoing relates to exemplary embodiments of the invention and that modifications may be made without departing from the spirit and scope of the invention as set forth in the following claims.

What is claimed is:

1. A decorative hair accessory comprising:

a first and a second semicylindrical element rotatably connected by a hinge configured to rotate between a first open position and a second closed position, each of the first and second semicylindrical elements defining a concave interior surface and a convex exterior surface extending between opposing side margins along a longitudinal length, wherein the length of each of the side margins of each of the first and second semicylindrical elements are defined by both male and female engaging surfaces configured to matingly engage with corresponding male and female engaging surfaces of the side margins of the other of the first and second semicylindrical elements, where in the first open position, the concave interior surface of at least one of the first and second semicylindrical elements is capable of receiving hair of a user; and where in the second closed position, the concave interior surfaces and the opposing side margins of both the first and second semicylindrical elements face one another, latching the decorative hair accessory closed along its longitudinal length and forming a tubular outer shape;

a first attachment means on the convex exterior surface of at least one of the first and second semicylindrical elements; and at least one interchangeable decorative component having a top and bottom surface, with a second attachment means on the bottom surface operative to removably rotatably couple with the first attachment means, and an indicium on the top surface configured to be viewable to an observer when the interchangeable decorative component is secured to the first attachment means by way of the second attachment means.

2. The decorative hair accessory of claim 1, wherein the first and second attachment means are selected from the group consisting of: an aperture with at least one keyed locking structure, magnets, snaps, clips, hooks, and combinations thereof.

3. The decorative hair accessory of claim 1, further comprising at least one hairpin slot on the convex exterior surface of at least one of the first and second semicylindrical elements, said at least one hairpin slot being spaced from the side margins of the first and second semicylindrical elements.

4. The decorative hair accessory of claim 1, wherein at least one curved finger tab extends from the convex exterior surface of both the first and second semicylindrical elements.

5. The decorative hair accessory of claim 1, wherein the first attachment means is a slotted aperture with a keyway and a radial undercut groove and the second attachment means is a tabbed protuberance mated to the slotted aperture, wherein the tabbed protuberance comprises a radially extending tab operative to move within the radial undercut groove.

6. The decorative hair accessory of claim 1, wherein the interchangeable decorative component is square with rounded corners and the second attachment means comprises a cylindrical protrusion centrally located on a substantially planar surface with a tab extending radially from an end of the cylindrical protrusion.

7. The decorative hair accessory of claim 1, wherein the indicium is on a substantially planar surface with a frame extending perpendicularly therefrom.

8. The decorative hair accessory of claim 1, further comprising:

at least one hairpin slot on the convex exterior surface of at least one of the first and second semicylindrical elements wherein at least one curved finger tab extends from the convex exterior surface of each of the first and second semicylindrical elements wherein the first attachment means is a slotted aperture with a keyway and a radial undercut groove adjacent to a perimeter of the slotted aperture;

wherein the at least one interchangeable decorative component is square with rounded corners and the second attachment means comprises a cylindrical protrusion, with a tab extending radially therefrom, located centrally on the bottom surface and mated to the slotted aperture; and wherein the top surface has a frame extending perpendicularly therefrom.

* * * * *